US006809696B1

(12) United States Patent
Bergmark et al.

(10) Patent No.: US 6,809,696 B1
(45) Date of Patent: Oct. 26, 2004

(54) MICROWAVE COMPONENTS

(75) Inventors: Pontus Bergmark, Billdal (SE); Anders Remgård, Mölndal (SE)

(73) Assignee: Polymer Kompositer I Goteborg AB, Molndal (SE)

( * ) Notice: Subject to any disclaimer, the term of this patent is extended or adjusted under 35 U.S.C. 154(b) by 140 days.

(21) Appl. No.: 10/110,927

(22) PCT Filed: Oct. 18, 2000

(86) PCT No.: PCT/SE00/02019

§ 371 (c)(1),
(2), (4) Date: Aug. 8, 2002

(87) PCT Pub. No.: WO01/29924

PCT Pub. Date: Apr. 26, 2001

(30) Foreign Application Priority Data

Oct. 18, 1999 (SE) ..... 9903782

(51) Int. Cl.[7] ..... H01Q 13/02; H01P 3/12

(52) U.S. Cl. ..... 343/786; 29/600; 333/208; 333/239

(58) Field of Search ..... 343/786; 29/600; 333/208, 239, 248, 249

(56) References Cited

U.S. PATENT DOCUMENTS

| | | | | |
|---|---|---|---|---|
| 3,969,814 | A | 7/1976 | Toy et al. | 29/600 |
| 3,982,215 | A | 9/1976 | Lo et al. | 333/208 |
| 4,020,875 | A | 5/1977 | Akiba | 138/128 |
| 5,182,849 | A | 2/1993 | Marco | 29/600 |

FOREIGN PATENT DOCUMENTS

| | | |
|---|---|---|
| EP | 0 569 015 A2 | 11/1993 |
| GB | 2 248 274 A | 4/1992 |
| JP | 61-79303 | 4/1986 |

*Primary Examiner*—Michael C. Wilmer
(74) *Attorney, Agent, or Firm*—Harness, Dickey & Pierce, P.L.C.

(57) ABSTRACT

A microwave component with an at least partially enclosed cavity, such as a microwave filter, a waveguide or a horn antenna, includes an outer support structure and an electric layer which is made of pulse-plated silver and which is arranged on the inside of the support structure and faces the cavity. The microwave component further includes a first inner protective layer of chemically precipitated gold, the protective layer being arranged on the electric layer and facing the cavity.

38 Claims, 3 Drawing Sheets

MICROWAVE COMPONENTS

This application is the national phase under 35 U.S.C. § 371 of PCT International Application No. PCT/SE00/02019 which has an International filing date of Oct. 18, 2000, which designated the United States of America, the entire contents of which are hereby incorporated by reference.

TECHNICAL FIELD

The present invention relates to microwave components with an at least partially enclosed cavity which are suitable for mass production and which satisfy high quality requirements. Examples of such microwave components are microwave filters, waveguides and horn antennas. The invention further relates to a method of manufacturing such components.

BACKGROUND

The manufacture of products of the above-mentioned kind has up to now been very complicated and expensive. Today the manufacture is primarily performed by working aluminium, inter alia by high-speed milling and subsequent surface finishing, such as silver-plating, coating, etc. As a result, it is time-consuming to manufacture each component and a great number of manual operations are necessary. Furthermore, it is difficult to obtain the desired dimensional tolerances and quality of the product by this manufacturing process. Thus, as a rule these products need considerable after-treatment.

To solve these problems, the filter casings have, for instance, been provided with trimming means, which allow trimming of the filters after final assembly. However, this makes the filters even more complicated and expensive to manufacture. Moreover, this makes it necessary to test and trim each filter separately by a specialist.

The manufacturing process also significantly limits the possibility of manufacturing certain component parts. High-speed milling allows milling of simple geometric designs only, which makes it necessary to manufacture complicated geometric designs in several pieces, which are subsequently assembled into one functional unit. However, such assembly of several subcomponents into a microwave component almost inevitably leads to a lower degree of dimensional accuracy in the final product, which results in an even greater need for trimming, for instance, of filters after assembly. To arrange trimming means on the filters is time-consuming and considerably increases the costs.

The use of trimming means, such as trimming screws, and the assembly of products from several including parts also constitute a risk of electric disorders, so called passive intermodulation (PIM). In some applications, this can be disastrous.

The making of the structural or supporting parts of aluminium also limits the thermal dimensional stability and the weight.

As an alternative, it has been proposed in JP 61 079 303 to manufacture waveguides on fusible cores. Around this core, silver and copper are plated, and a carbon fibre fabric is subsequently wound around the core until a thickness of about 2 mm. During the winding, the fabric is impregnated with epoxy resin, and the wound support structure is subsequently cured by supplying heat and pressure, after which the core is melted out. The resulting waveguide consists of a composite structure having continuous carbon fibres with an inner layer of copper and silver.

However, also this manufacturing method suffers from a number of drawbacks. The method is expensive and complicated and requires a great number of manual operations. Thus the method is not suitable for mass production, and the manufacturing time for each component is long and the costs are high.

In addition, the technique is not applicable to the manufacture of filter casings, since it is not possible to wind the carbon fibre fabric in the narrow, downwardly projecting, often circular cavities in the filter casings, or corrugations in horn antennas.

Furthermore, in the prior-art wound carbon fibre waveguide the copper layer cannot affect the rigidity and the thermal stability of the component. In this case, the higher e-module of the carbon fibre structure completely dominates the copper layer, and at temperature changes, which frequently occur in microwave components, this may cause micro-cracking problems in the metal layer. Other problems that may arise are reduced adherence of the composite to the metal and galvanic corrosion due to humidity entering the waveguide through the cracks. The presence of micro-cracks in microwave components, and especially microwave filters, immediately results in reduced electric properties.

It is also a problem with prior-art microwave components that the sensitive electric layer, which internally faces the cavity, often gets damaged either during the manufacturing process or during the use of the component due to different types of environmental influence. This is very serious, since it considerably changes and deteriorates the qualities of the component and usually makes it necessary to replace and discard the component.

Consequently, there is a need for microwave components which can be manufactured at a lower cost and in a more efficient manner, in particular on a large scale, and which also provide better products, have a greater resistance against environmental influence, improved dimensional accuracy, improved thermal dimensional stability, fewer including parts to be integrated and improved electric properties.

OBJECT OF THE INVENTION

Thus, the object of the present invention is to provide microwave components with cavities, which wholly or at least partly obviate the above-mentioned problems. The invention also provides a method of manufacturing such microwave components.

This object is achieved by means of a microwave component and a method according to the appended claims.

SUMMARY OF THE INVENTION

The invention relates to microwave components with an at least partially enclosed cavity, comprising an outer support structure and an electric layer, which is preferably made of silver and which is arranged on the inside of the support structure. The microwave components according to the invention are distinguished in that they further comprise a first inner protective layer of gold (D), said protective layer being arranged on the electric layer (C) and facing the cavity.

The protective layer is preferably a chemically precipitated gold layer. By arranging such a protective layer, the sensitive electric layer is protected against environmental influence and damage, at the same time as the electric function is not affected to any substantial degree. Unlike prior-art methods of protecting silver surfaces for electric use in microwave components, a gold layer arranged directly on the silver surface has the advantage that it can be made thin, yet completely tight, and it also provides a lasting protection against the environment. In contrast to galvanically applied gold, a chemically applied gold layer provides completely tight layers in the small thicknesses that are electrically acceptable in these connections.

The structure of the electric layer is of great importance. Silver offers by far the best electric properties compared with other conducting materials. The electric properties have a great influence on the performance of microwave components, The application of silver by pulse-plating additionally improves the evenness and tightness of the layer. Pulse-plated silver also permits satisfactory macro spreading, thus allowing plating in narrow spaces, which is not possible by conventional direct-current plating. This is crucial as the cavities almost exclusively have partial surfaces and edges that are located at different distances from the power source. The addition of a protecting chemically precipitated gold layer on the silver layer has surprisingly been found to offer many advantages. A chemically precipitated gold layer is considerably tighter than, for instance, galvanically precipitated gold layers. One advantage of chemically precipitated gold on pulse-plated silver is thus that the even and tight silver is protected by a gold layer which is very thin but still tight. The alternative of using a galvanically applied gold layer requires a considerably thicker layer to attain the same tightness, usually more than ten times thicker. Microwaves in a component penetrate into the metal layers and a great disadvantage of galvanically applied layers is that the thicker gold layer reduces the electric properties of the component due to the lower conductivity of the gold. In addition, the inferior electric properties are further deteriorated since the composition of the layer will be uneven as a consequence of the uneven distribution of the field strength. From the point of view of production, galvanically applied layers are also disadvantageous, compared with chemically precipitated gold, due to longer manufacturing time, increased thickness margin owing to unevenly composed layers, higher material costs as well as higher weight.

An alternative way of applying a gold layer is to passivate silver, for instance, with an organic substance. But this is disadvantageous for several reasons. Unlike the precious metal gold, organic substances react with a number of substances which can change the composition of the surface. Organic substances allow diffusion of substances through the layer to a considerably larger extent and thus cannot afford such a complete protection. The organic layer is less resistant to high field strength. The organic layer has less temperature resistance and less resistance to decomposition. When using organic layers, it is more important that the layers be thin as organic layers are not electrically conducting and thus have a detrimental effect on the electric properties, such as conductivity. An organically composed layer does not provide the same mechanical strength as a metal gold layer. As a consequence, there is a considerably increased risk of the layer breaking through in contact surfaces and other surfaces exposed to wear. If this happens, the electric signals can be influenced in an uncontrollable manner by the occurrence of differences in conductivity and insulation in the component.

On the other hand, it has surprisingly been found that the arrangement of a protective layer of chemically precipitated gold provides excellent protection against environmental influence on the electric layer, at the same time as the layer can be made so thin that the electric properties of the component will not be affected to any appreciable extent.

Furthermore, the outer support structure is preferably made of a cast material, such as a castable metal or a ceramic or plastic material, and made in one integral piece. By using a castable material for the manufacture, the dimensional accuracy increases essentially, at the same time as the manufacturing can be performed in a rapid and efficient manner and is thus well suited for mass production of such components. Unlike, for instance, wound carbon fibre fabric, an integral support structure has omnidirectional mechanical and thermal properties. This is a great advantage, especially in case of complicated geometric designs, such as cavities in filter casings and corrugations in horn antennas. In addition, it is usually these geometric designs that have the narrowest tolerances of the components. The provision of a support structure with omnidirectional properties therefore contributes to a great extent to achieving satisfactory repeatability in mass production.

The outer support structure can, as an alternative, be composed of one or more metal layers against the conducting silver layer.

Thanks to the improved properties of the microwave component according to the invention relative to parts which are formed by after-treatment, such as high-speed milling, and which are manufactured by winding or the like, the finished component can be provided without trimming. This means that it is possible to guarantee such a quality that extra trimming means, which were formerly necessary in many connections, can be omitted which results in considerable savings. Furthermore, the PIM-levels will be very low and in most cases substantially negligible. Depending on the choice of material, improved dimensional stability under heat, a lower weight of the product, improved environmental resistance and extremely good dimensional accuracy are also obtained.

Thanks to the use of the cast or plated outer support structure, it is also possible to provide geometrically complicated microwave components, such as integrated filter casings, waveguide systems and similar put-together products made in one piece, which facilitates assembly and reduces the risk of electric loss.

The composition structure according to the invention is in particular suitable for microwave components with cavities for telecommunication, comprising a partially enclosed cavity and electric connections arranged on at least one side of said cavity. The tolerance requirements for this type of component are very critical, and therefore there is a great need of an improved product which reduces the need of after-treatment and trimming. Due to the fact that the outer support structure is made in one integral piece, it is also possible to manufacture the entire microwave component, including the inner walls and the like and electric connections for the coupling to the rest of the waveguide system, in one piece. Consequently, it is possible to obtain high functionality within a small volume.

For essentially the same reasons, the inventive structure is further suitable for waveguides for microwaves, which waveguides comprise a cavity and electric connections arranged on at least one side of said cavity. The invention is particularly suitable for waveguides in which the cavity is bent in at least one plane and preferably in a plurality of planes. Such complicated geometric designs are substantially impossible to produce in one piece by present-day techniques. It is also possible to provide waveguides in which the cavity is twisted by means of the inventive structure.

The outer support structure of the microwave components according to the invention preferably has such dimensional tolerance and thermal stability at the inner surface that the electric requirements can be fulfilled without trimming. Thus the need of after-adjustment and trimming during assembly is avoided as well as the need of arranging trimming means on the component.

It is also possible to choose a material for the outer support structure that is at least partially flexible and which allows at least some degree of twisting or bending of the component. As a result, some degree of flexibility can be imparted to the cavities of microwave components, and one type of component can be used in a great number of applications. This increases the usability of each product and improves the possibilities of mass production in greater series.

Furthermore, for many purposes the outer support structure preferably comprises zinc, tin or alloys of these materials, since all these materials are castable and have very good properties as regards thermal stability.

On the other hand, for other purposes the outer support structure preferably comprises epoxy plastic material, which is further preferably filled with reinforcing particles of harder material, such as micro-carboys or homogeneous micro-spheres, which particles preferably have a size in the range of 10–350 $\mu$m. The particles, which can also be used as filling in castable metals, increase the rigidity and the thermal stability of the material.

As concerns the dimensions, the outer support structure preferably has a thickness that is less than 5 mm and the electric layer a thickness that is less than 10 $\mu$m.

The inventive microwave component preferably comprises an inner support structure made, for instance, of copper, said support structure being arranged between the outer support structure and the electric layer and adapted to impart improved thermal stability and/or mechanical strength to the component in interaction with the outer support structure. The use of two support structures, one outer that is cast or plated in one or more layers, and one inner that is for instance plated, provides an often necessary possibility of trimming the mechanical and thermal properties of the components by the choice of material combinations and layer thicknesses of the structures. The thus-obtained interaction between the outer and the inner support structure is particularly important when manufacturing microwave components with cavities in one piece, which components lack after-trimming means. The tolerance requirements as to the dimensions in this application are usually extremely narrow and often less than 10 $\mu$m. The inner support structure advantageously has a thickness of between 5 and 200 $\mu$m. The inner support structure, which preferably consists of copper, affects the rigidity and thermal stability of the component and increases the adhesion of the inner surface. Unlike prior-art solutions, none of the support structures will in this case totally dominate the other, which guarantees an efficient interaction between them. The support structure can be composed of one or more layers.

It is also suitable for the protective layer to be arranged on the electric layer, preferably so as to cover the same completely, and to have such a small thickness, preferably less than 0.5 $\mu$m, that the electric properties of the component are not affected to any considerable extent.

In many cases, a protective layer, for instance of chemically precipitated gold, is preferably arranged on the outer layer. It may also be advantageous to arrange a protective layer between the inner and the outer support structure when the outer support structure is not made of metal. In this way, the inner layers are protected against outside environmental influence.

The invention also relates to a corresponding method of manufacturing the microwave components according to that stated above.

BRIEF DESCRIPTION OF THE DRAWINGS

The invention will now be described in more detail for the purpose of exemplification by means of embodiments and with reference to the accompanying drawings, in which.

DESCRIPTION OF PREFERRED EMBODIMENTS

The invention concerns microwave components with a new, improved structure, and a microwave filter, a waveguide and a horn antenna according to the invention will now be described in more detail.

Figure 1A:
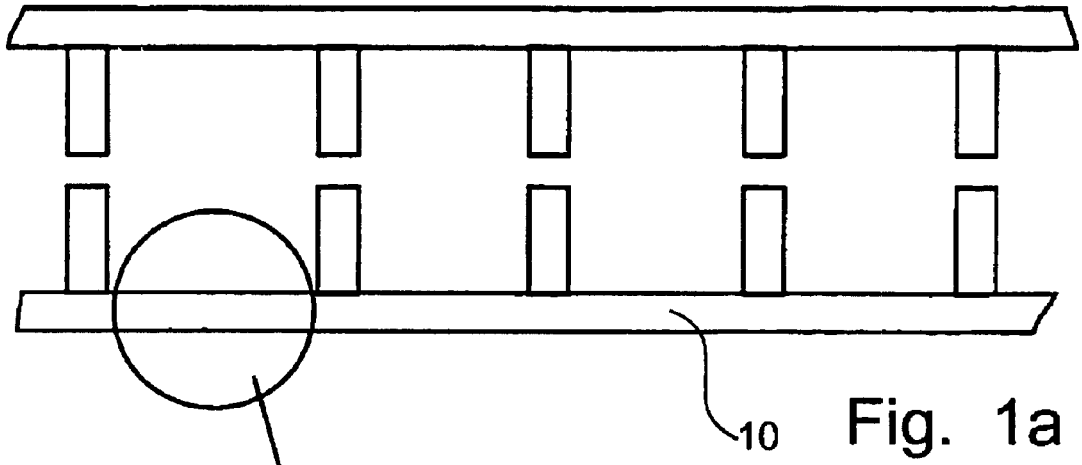
FIG. 1*a* is a schematic cross-sectional view of a part of a filter casing according to an embodiment of the invention.
Figure 1B:
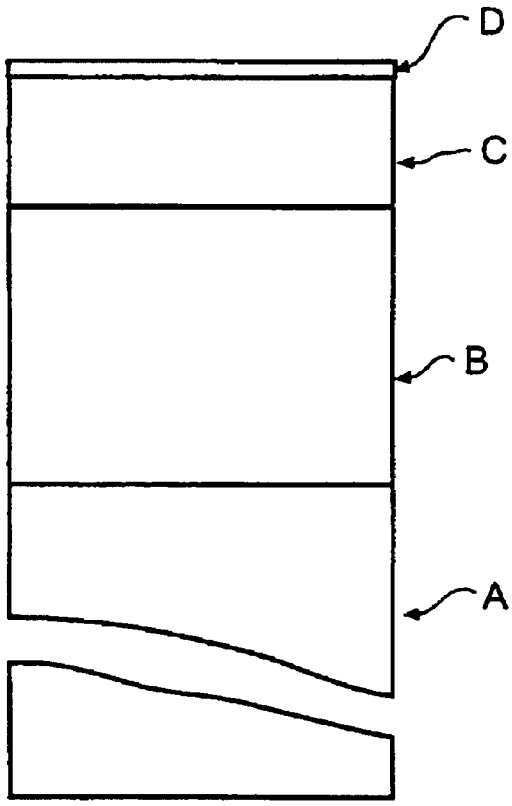
FIG. 1*b* is a cross-sectional view on a larger scale of a part of the wall in the filter casing in FIG. 1*a;*

FIG. 1*a* schematically shows a microwave filter for base stations for mobile telephony according to the invention, comprising a microwave component with a cavity, in this case a filter casing 10, and electric connections, in this case connecting flanges (not shown), arranged on at least one side of said cavity. The microwave filter has a wall construction which is schematically shown in FIG. 1*b*. The wall comprises on the outside an outer support structure A made of a cast material, such as a castable metal or a ceramic or plastic material. It is, however, also possible to use copper or other materials which are not cast as the outer support structure. The material should be chosen so that the outer support structure has such dimensional tolerance and thermal stability that electric requirements can be met without trimming. Preferably, use is made of epoxy plastic material, which is further preferably filled with reinforcing particles of harder material, such as micro-carboys or homogeneous micro-spheres, to increase the thermal stability and the strength. These particles should have a nominal particle size in the range of 10–350 $\mu$m. Plastic materials have several advantages, such as being cheap and easy to treat. It is also possible to use zinc, tin or alloys of these materials. The outer support structure suitably has a relatively great thickness to impart strength to the component, but preferably less than 5 mm. Furthermore, the outer structure of the component should be made in one integral piece.

On the inside of the outer support structure, an inner support structure B is preferably arranged, which is preferably made of metal, for instance copper. This layer should be adapted to impart improved thermal stability and/or mechanical strength to the component in interaction with the outer support structure. A suitable thickness of this layer is between 5 and 200 $\mu$m. It is in particular important to use an inner support structure in the cases where plastic or ceramic materials are used for the outer structure, since the inner layer thus forms a barrier which protects the interiorly situated sensitive electric layer against moisture and the like which is being transferred in the outer layer, against thermal stress between the materials, etc.

Between the outer and the inner support structure, a protective layer, for instance made of chemically precipitated gold (not shown), can advantageously be arranged to protect the inner layers against outside environmental influence.

Subsequently, on the inner support layer the electric layer C is arranged, which is for instance made of silver. Gold or copper can, however, be used instead in some cases. When the inner support layer is omitted, the electric layer is arranged directly on the inside of the outer structure. The electric layer preferably has a thickness that is smaller than 10 $\mu$m.

On the inside of the electric layer, it is advantageous to arrange a protective layer D, a so-called environment protecting means. This layer preferably completely covers the electric layer and should have such a small thickness that the electric properties of the component are not affected to any considerable extent. Use is preferably made of a thickness smaller than 0.5 $\mu$m. The protective layer can advantageously be a chemically precipitated gold layer. The protective layer is particularly important when silver is used as electric layer material, since it protects the silver against sulfidation. In this case, it is also particularly suitable to use chemically precipitated gold as a protective layer.

Figure 2A:
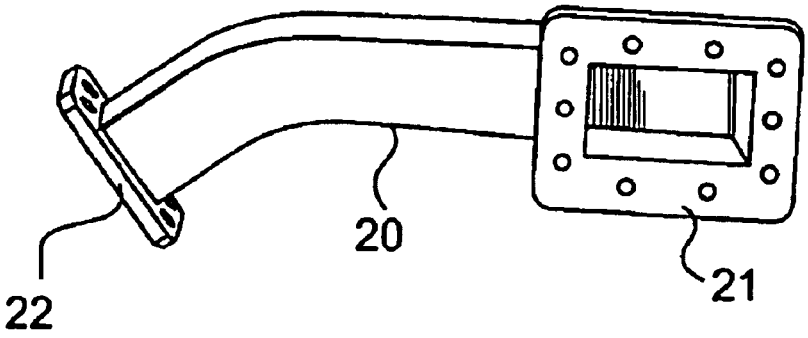
FIG. 2*a* is a lateral view of a waveguide according to an embodiment of the invention.
Figure 2B:
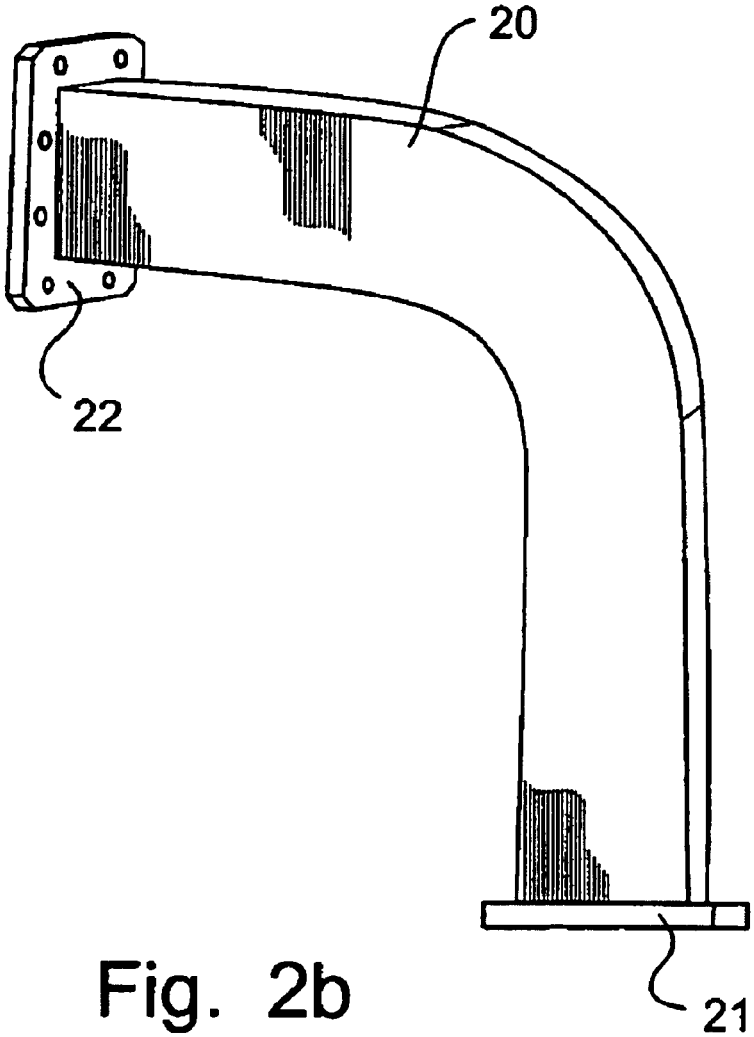
FIG. 2*b* is a top plan view of the waveguide in FIG. 2*a*.

FIG. 2 shows an inventive waveguide for microwaves, comprising a cavity, in this embodiment in the form of a waveguide part 20, and electric connections, in this embodiment in the form of connecting flanges 21, 22, arranged on both sides of said cavity 20. The waveguide has a wall structure corresponding to that of the filter casing described above. This structure is particularly suitable for waveguides in which the cavity is bent in at least one plane and preferably in a plurality of planes, and the illustrated cavity is bent, on the one hand, in a horizontal plane (see FIG. 2*a*) and, on the other, in a vertical plane (see FIG. 2*b*). Such integrally formed waveguides could not be manufactured using prior-art structures and were therefore composed by joining a plurality of different parts. Also with this structure the cavity can be twisted.

In particular in the case of waveguides, the outer support structure often preferably comprises an at least partially flexible material. This allows at least some degree of twisting or bending of the component, and one and the came component can thus easily be adjusted to various application situations. Such flexibility can, however, also be desirable in connection with other types of microwave components.

Figure 3:
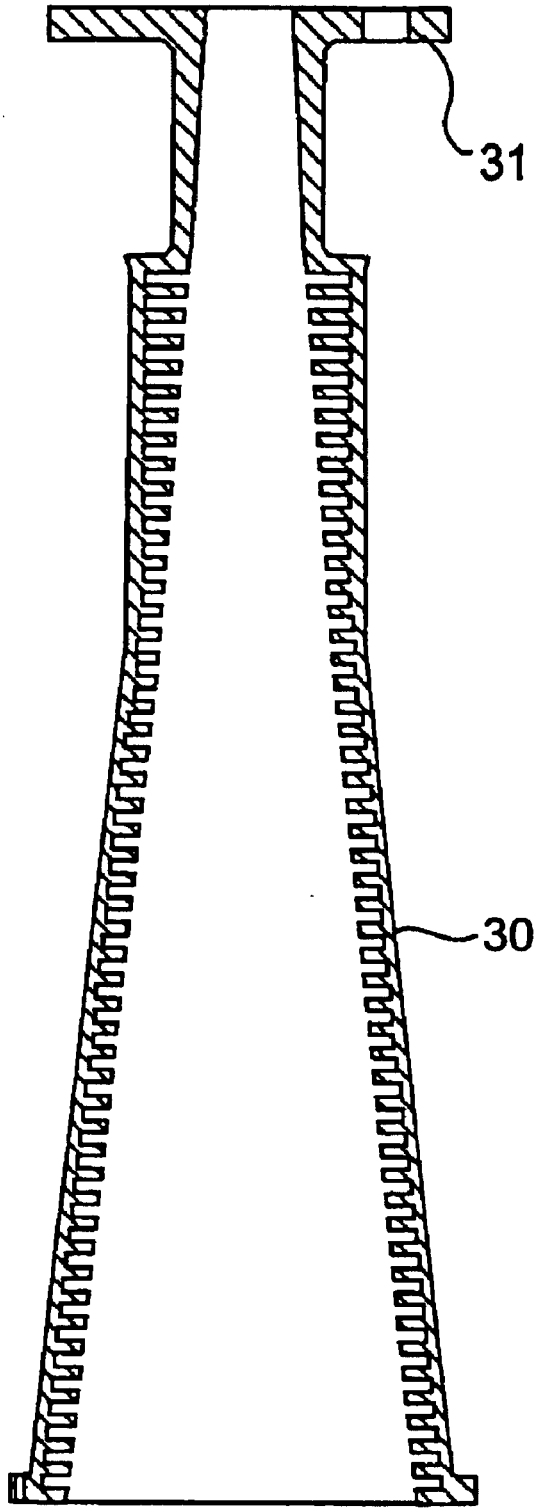
FIG. 3 is a schematic cross-sectional view of a corrugated horn antenna according to an embodiment of the invention.

FIG. 3 schematically shows an inventive corrugated horn antenna for microwaves. This horn antenna comprises an internally corrugated antenna part 30 and electric connections, here in the form of connecting flanges 31, arranged on at least one side of said antenna part 30. The antenna has a wall structure corresponding to the wall structure of the above-described filter.

When manufacturing the above-described type of microwave components, an inner core is first manufactured of a fusible material. This inner core is given a shape corresponding to the desired cavity of the microwave component which is to be manufactured. Especially narrow gaps, slits and the like can be made in the core to form thin walls within the manufactured body. This is particularly desirable when manufacturing the inner walls of the microwave component surrounding the cavity, but also when manufacturing the corrugation of horn antennas and the like. The form tool, i.e. the inner core, is also preferably made by casting in a mould, which makes the process easily repeatable as this mould can be reused.

Subsequently, round the inner core, an outer casting mould is arranged, which is filled with cast compound round the inner core. The choice of cast compound depends on what application the component is intended for and has been discussed above. After the cast compound has been cured, the outer casting mould is removed, after which the inner core is melted out of the cast product. Before or after melting out the inner core, the electric layer is arranged on the inner surface of the cast product, as the other layers described above. These layers are preferably applied to the fusible inner core starting from the inside. The layers can, for instance, be applied by plating by means of an electric or preferably chemical method. The chemical method provides an even deposition of the material over the surface, whereas the electric method provides a layer which gets thicker in the corners and similar places where the electric field is reinforced and thinner on hidden surfaces where the field is weakened.

By means of chemical or electric methods, it is, as already mentioned, also possible to apply, for instance, copper as a protective layer instead of arranging a cast support layer.

By means of the above method, the above-described structure of microwave components can be obtained in a simple and efficient manner, and the method also allows mass production. By carefully forming the outer surface of the core, which surface is relatively easy to work, it is possible to obtain very good dimensional accuracy of the final product and especially of the sensitive inner surfaces which are facing cavities enclosed in the component. It is further easy to provide narrow and thin internal structures, such as walls, in the microwave components. It is also possible by means of this method to manufacture several products in the same process by using several form tools, which makes the manufacturing process considerably more efficient.

By means of the inventive method, it is also possible to manufacture microwave components in which additional components are integrated in the cavity walls. In the walls of the tool that is used to manufacture the fusible core, other pre-manufactured parts and components can be fitted, before the tool is filled with the melt. These parts can be bars, spirals, walls, etc. They can also be integrated circuits which are mounted, for in-stance, on ceramic plates or other insulating bases. The parts are subsequently enclosed by the melt after the filling. However, the part or parts which are inserted into the wall of the steel tool and which fix the part during filling will not be enclosed by the melt. When removing the core, the parts project from the wall of the core. In the subsequent application of the support structure by plating or casting, the projecting parts are fixed into the wall of the cavity. Thus the fixing primarily takes place on the inside, but cooling flanges etc can, of course, be arranged on the outside in the same manner.

Instead of inserting the pre-manufactured parts into the steel tool, cavities can also be made in the core where the parts are placed afterwards. The advantage of the first variant is, however, that the parts can be inserted in different directions independently of how the steel tool is removed from the core.

The advantages of the components and the method according to the invention are, among other things, that a thermal expansion, CTE (Coefficient of Thermal Expansion), is obtained, which is considerably lower than that of e.g. aluminium. Another advantage is that more complex products can be manufactured. This is advantageous in electric applications, resulting in fewer contact surfaces, better environmental resistance, more stable electric performance, etc. Furthermore, the manufacture is cheap and allows a high rate of production. The final product will also be better than by means of conventional methods. The product can, for instance, be made lighter and thinner without reduced strength and the like. Furthermore, the material has satisfactory dimensional accuracy and dimensional stability. By using a core, a form tool, around which the product is formed, it is also possible, as already mentioned, to provide very thin walls and similar details, which is essentially impossible by conventional methods.

During plating, the thickness of the walls of the body primarily depends on for how long the plating is allowed to last, but also on parameters such as temperature, the composition of the bath and pH.

The invention has been described by means of embodiments. It will, however, be understood that many variants of the invention, besides those described above, such as the use other materials, other methods of arranging the different layers of material, the manufacture of the other microwave components, etc, are possible. Such obvious variants must be considered to fall within the scope of the invention such as defined by the appended claims.

What is claimed is:

1. A microwave component with an at least partially enclosed cavity, comprising:

an outer support structure;

an electric layer, made of pulse-plated silver and arranged on the inside of the support structure and facing the cavity; and a first inner protective layer of chemically precipitated gold, said protective layer being arranged on the electric layer and facing the cavity, wherein the cavity includes a plurality of put-together cavities, the electric layers of the respective cavities being interconnected.

2. A microwave component as claimed in claim 1, wherein the protective layer covers substantially completely the electric layer which faces the cavity.

3. A microwave component as claimed in claim 1, wherein the outer support structure is made in one integral piece.

4. A microwave component as claimed in claim 1, further comprising electric connections which are connected to the electric layer and arranged on at least one side of said cavity.

5. A microwave component as claimed in claim 1, wherein the component is at least one of a microwave filter and a multiplexer for telecommunication, comprising an at least partially enclosed cavity and electric connections arranged on at least one side of said cavity.

6. A microwave component as claimed in claim 1, wherein the component is a waveguide for microwaves, comprising a waveguide cavity and connecting flanges arranged on at least one side of said cavity.

7. A microwave component as claimed in claim 6, wherein the cavity is bent in at least one plane.

8. A microwave component as claimed in claim 1, wherein the component is a corrugated horn antenna for microwaves, comprising an internally corrugated antenna part and electric connections arranged on at least one side of said antenna part.

9. A microwave component as claimed in claim 1, wherein the outer support structure has such thermal stability and the electric layer has such electric properties and dimensional tolerances that electric requirements on the component can be fulfilled without trimming or similar adjustment after manufacture.

10. A microwave component as claimed in claim 1, wherein the outer support structure comprises an at least partially flexible material which allows at least some degree of twisting or bending of the component.

11. A microwave component as claimed in claim 1, wherein the outer support structure is made of copper.

12. A microwave component as claimed in claim 1, wherein the outer support structure is made of a cast material, including at least one of castable metal and a ceramic or thermosetting plastic material.

13. A microwave component as claimed in claim 12, wherein the outer support structure comprises at least one of zinc, tin and alloys of zinc or tin, which is further filled with reinforcing particles of harder material, including at least one of micro-carboys and homogeneous micro-spheres, which particles have a size in the range of 10–350 $\mu$m.

14. A microwave component as claimed in claim 12, wherein the outer support structure comprises epoxy plastic material, which is further filled with reinforcing particles of harder material, including at least one of micro-carboys and homogeneous micro-spheres, which particles have a size in the range of 10–350 $\mu$m.

15. A microwave component as claimed in claim 1, wherein the outer support structure has a thickness less than 5 mm.

16. A microwave component as claimed in claim 1, wherein the electric layer has a thickness less than 10 $\mu$m.

17. A microwave component as claimed in claim 1, further comprising an inner support structure made of copper, said support structure being arranged between the outer support structure and the electric layer and adapted to impart at least one of improved thermal stability and mechanical strength to the component in interaction with the outer support structure.

18. A microwave component as claimed in claim 17, wherein the inner support structure has a thickness of between 5 and 100 $\mu$m.

19. A microwave component as claimed in claim 17, further comprising a second protective layer arranged between the inner support structure and the outer support structure, which second protective layer includes a chemically precipitated gold layer.

20. A microwave component as claimed in claim 1, wherein the first protective layer has such a small thickness that the electric properties of the component are not affected to any considerable extent, and a thickness that is less than 0.5 $\mu$m.

21. The microwave component of claim 1, wherein the cavity is bent in a plurality of planes.

22. The microwave component of claim 7, wherein the cavity is bent in a plurality of planes.

23. A microwave component as claimed in claim 7, wherein the cavity is twisted.

24. A microwave component as claimed in claim 13, wherein the outer support structure comprises epoxy plastic material, which is further filled with reinforcing particles of harder material, including at least one of micro-carboys and homogeneous micro-spheres, which particles have a size in the range of 10–350 $\mu$m.

25. A microwave component as claimed in claim 18, further layer arranged between the inner support structure and the outer protective layer includes a chemically precipitated gold layer.

26. A microwave component with an at least partially enclosed cavity, comprising:

an outer support structure;

an electric layer, made of pulse-plated silver and arranged on the inside of the support structure and facing the cavity, and a first inner protective layer of chemically precipitated gold, said protective layer being arranged on the electric layer and facing the cavity, wherein the component is a waveguide for microwaves, including a waveguide cavity and connecting flanges arranged on at least one side of said cavity, and wherein the cavity is bent in at least one plane.

27. A microwave component as claimed in claim 26, wherein the cavity comprises a plurality of put-together cavities, the electric layers of the respective cavities being interconnected.

28. A microwave component as claimed in claim 26, wherein the cavity is twisted.

29. A microwave component as claimed in claim 26, wherein the protective layer covers substantially completely the electric layer which faces the cavity.

30. A microwave component as claimed in claim 26, wherein the outer support structure is made in one integral piece.

31. A microwave component as claimed in claim 26, further comprising electric connections which are connected to the electric layer and arranged on at least one side of said cavity.

32. A microwave component as claimed in claim 26, further comprising an inner support structure made of copper, said support structure being arranged between the outer support structure and the electric layer and adapted to impart at least one of improved thermal stability and mechanical strength to the component in interaction with the outer support structure.

33. A method of manufacturing microwave components with an at least partially enclosed cavity, comprising the steps of:

manufacturing an inner core made of a fusible material, which has a shape corresponding to that of the cavity of the microwave component which is to be manufactured;

chemically precipitating a protective layer of gold on the core;

arranging an electric layer of silver on the gold layer;

arranging outside the electric layer an outer support structure; and melting out the inner core.

34. A method as claimed in claim 33, comprising the additional step of inserting pre-manufactured parts, when manufacturing the inner core, which are arranged so that they project from the core at least with some part, and integrating these projecting parts in the outer support structure when arranging the same.

35. A method as claimed in claim 34, wherein the projecting parts are also integrated with the electric layer.

36. A method as claimed in claim 33, wherein the step of manufacturing the inner core comprises the substeps of:

arranging in a casting tool pre-manufactured parts, which are inserted with at least some part into the walls of the casting tool;

inserting fusible material into the casting tool to cast the inner core; and separating the inner core together with the pre-manufactured parts arranged therein from the casting tool.

37. A method as claimed in claim 33, wherein the step of manufacturing the inner core comprises the substeps of:

arranging inwardly protruding parts in a casting tool;

inserting fusible material into the casting tool to cast the inner core;

separating the inner core from the casting tool, cavities being formed in the positions of the inwardly protruding parts of the casting tool; and inserting pre-manufactured parts into the cavities so that they project from the core with at least some part.

38. The method as claimed in claim 35, wherein the projecting parts are integrated with the protective layer.

* * * * *